US005598919A

United States Patent [19]

Taylor

[11] Patent Number: 5,598,919

[45] Date of Patent: Feb. 4, 1997

[54] RESEALABLE CONTACT LENS POUCH AND METHOD OF USING

[75] Inventor: Christy Taylor, Irvine, Calif.

[73] Assignee: Allergan, Inc., Irvine, Calif.

[21] Appl. No.: 291,785

[22] Filed: Aug. 17, 1994

Related U.S. Application Data

[63] Continuation of Ser. No. 52,053, Apr. 21, 1993, abandoned.

[51] Int. Cl.[6] ..... A45C 11/04

[52] U.S. Cl. ..... 206/5.1; 206/205; 383/37; 383/63

[58] Field of Search ..... 206/5.1, 205, 210; 383/37, 40, 63

[56] References Cited

U.S. PATENT DOCUMENTS

| | | | |
|---|---|---|---|
| 3,369,656 | 2/1968 | Skinner, Jr. | 206/5.1 |
| 3,685,645 | 8/1972 | Kawaguchi | 206/210 |
| 3,802,919 | 4/1974 | Saffir | 383/63 |
| 4,246,288 | 1/1981 | Sanborn, Jr. | 383/63 |
| 4,691,820 | 9/1987 | Martinez . | |
| 4,709,398 | 11/1987 | Ausnit | 383/63 |
| 4,846,585 | 7/1989 | Boeckmann et al. | 383/63 |
| 4,863,285 | 9/1989 | Claxton | 383/63 |
| 4,925,318 | 5/1990 | Sorensen | 383/63 |
| 4,986,673 | 1/1991 | Bell | 383/63 |
| 5,004,356 | 4/1991 | Matsui | 383/63 |
| 5,005,695 | 4/1991 | Tennefos et al. | 383/63 |
| 5,053,208 | 10/1991 | Seamons et al. . | |
| 5,054,610 | 10/1991 | Ajello | 206/210 |
| 5,058,761 | 10/1991 | Williams | 383/63 |
| 5,186,543 | 2/1993 | Cochran | 383/63 |

FOREIGN PATENT DOCUMENTS

| | | | |
|---|---|---|---|
| 6474525 | 3/1989 | Japan | 206/5.1 |

*Primary Examiner*—David T. Fidei

*Attorney, Agent, or Firm*—Jeffer, Mangels, Butler & Marmaro LLP

[57] ABSTRACT

The combination of a resealable contact lens pouch and a contact lens care solution prefilled therein. The contact lens pouch can include multiple compartments each prefilled with a different contact lens care solution to enable cleaning, disinfecting and/or rinsing of a contact lens.

19 Claims, 1 Drawing Sheet

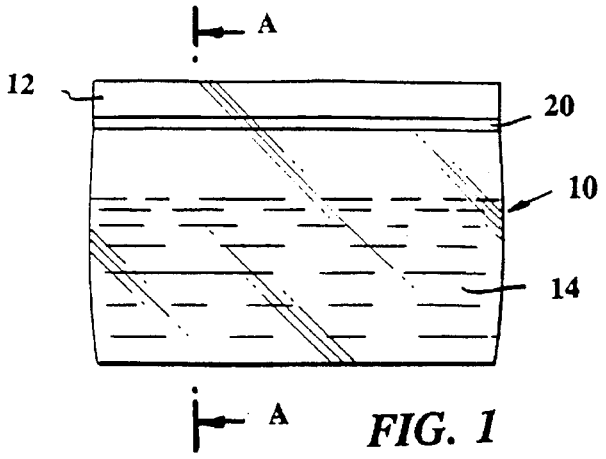
FIG. 1
FIG. 2
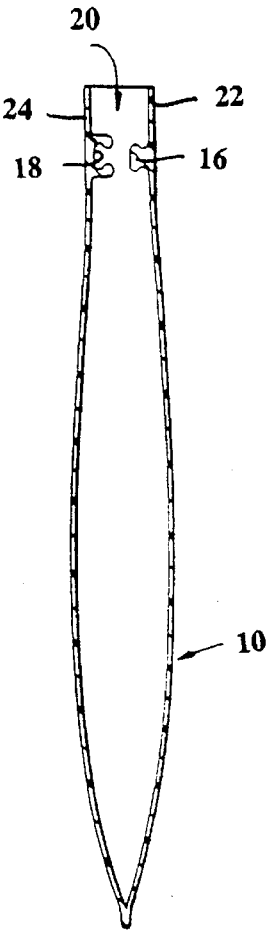
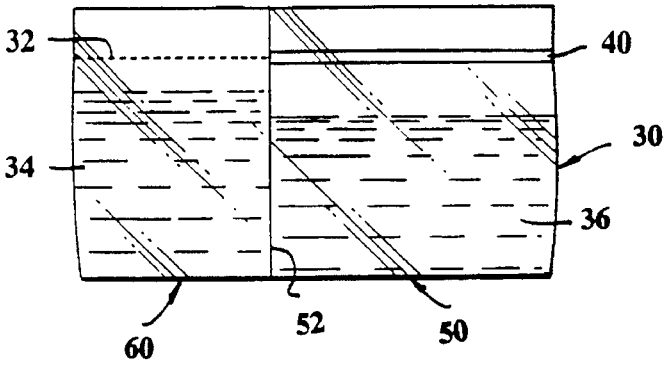
FIG. 3
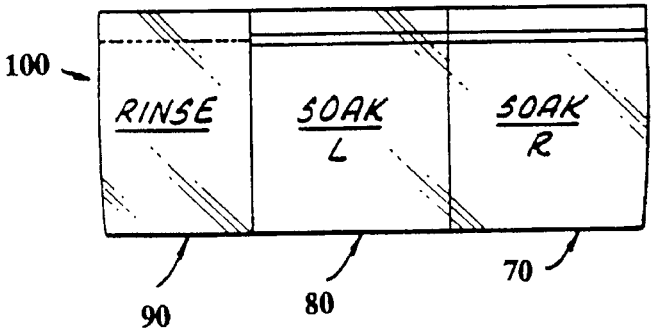
FIG. 4

RESEALABLE CONTACT LENS POUCH AND METHOD OF USING

This application is a continuation, of application Ser. No. 08/052,053, filed Apr. 21, 1993, now abandoned.

FIELD OF THE INVENTION

The present invention generally relates to a contact lens pouch prefilled with a contact lens care solution and more particularly relates to a resealable/disposable contact lens pouch prefilled with a contact lens care solution that is used to clean, store, disinfect and rinse a contact lens.

BACKGROUND OF THE INVENTION

In the care of contact lenses of various kinds, i.e., soft, hard, gas permeable, etc., a sterile environment is required where the lens can be cleaned and stored. This sterile environment usually means soaking the contact lens in a cleaning or sterilizing solution. This is especially important in the care of soft contact lenses made of hydrophilic polymeric materials. When not in the eye, these soft hydrophilic lenses need to be stored in either a disinfecting or sterile saline solution in order to keep them in their hydrated state. It is desirable for the contact lens wearer to have a readily accessible container for the safekeeping of contact lenses in a ready-to-wear condition.

Various designs of contact lens containers have been disclosed by others. For instance, U.S. Pat. No. 5,053,208 to Seamons, et al. discloses a contact lens disinfecting kit which has an open-top lens container, an elongated piercer mounted in the lens container in an upright position such that the piercer divides the interior of the lens container into two separate contact lens receiving ports. The Seamons, et al. device requires elaborate effort of piercing the compartment before using the container and moreover, it does not provide a resealable top.

U.S. Pat. No. 4,691,820 to Martinez discloses a molded blister package for storing and dispensing a hydrophilic contact lens which has a base portion which includes a cavity surrounded by an outstanding flange and a sheet cover sealed to the flange to enclose the cavity. The Martinez package is mainly used for shipping and dispensing contact lenses and is not amenable to reclosure once the package is opened.

It is therefore an object of the present invention to provide a contact lens pouch prefilled with a contact lens care solution for the cleaning and storing of a contact lens that does not have the drawbacks and shortcomings of the prior art contact lens containers.

It is another object of the present invention to provide a contact lens pouch prefilled with a contact lens care solution for the cleaning and storing of a contact lens that is readily accessible and can be conveniently carried around by the contact lens wearer.

It is a further object of the present invention to provide a contact lens pouch prefilled with a contact lens care solution for the cleaning and storing of a contact lens that can be used once and then be discarded.

It is yet another object of the present invention to provide a contact lens pouch prefilled with a contact lens care solution for the cleaning and storing of a contact lens that is equipped with a resealable top such that the pouch may be opened to accept a contact lens and then be resealed to achieve a fluid-tight seal.

It is another further object of the present invention to provide a contact lens pouch prefilled with a contact lens care solution for the cleaning and storing of a contact lens that is equipped with a plastic inter-locking device such that the pouch may be opened to accept a contact lens and then be resealed.

SUMMARY OF INVENTION

In accordance with the present invention, a contact lens pouch equipped with a resealable top and prefilled with a contact lens care solution that can be used to clean, disinfect, rinse and store a contact lens once and then be discarded is provided.

In the preferred embodiment, a contact lens pouch prefilled with a contact lens care solution is constructed with a resealable top equipped with a plastic inter-locking device. The contact lens pouch may be prefilled at the factory with a contact lens care disinfection solution and then be marketed at a pharmaceutical outlet. The contact lens wearer opens the resealable top to deposit a contact lens in the pouch for the cleaning, disinfecting and storing of the lens and then reseals the top. After a predetermined period of time necessary to disinfect the lens, the wearer opens the pouch again, removes and rinses the contact lens and places it in the eye. The pouch is then discarded. The pouch is flexible and can be carried around by the wearer conveniently in a pocket or in a purse. This preferred embodiment is most suitably used with an "all-in-one" type of contact lens care solution which accomplishes the functions of cleaning, disinfecting, storing, rinsing and lubricating a contact lens all by a single solution.

In a first alternate embodiment, a contact lens pouch may be constructed with two compartments with a fluid-tight seal thereinbetween. In the first compartment, a resealable top is provided such that the contact lens cleaning, disinfecting, and storing functions can be carried out by the wearer in the same way as that described in the preferred embodiment. The second compartment, which is juxtaposed to the first compartment, is equipped with a non-resealable, perforated tear-line at the top. This second compartment contains a solution for rinsing and lubricating the contact lens. A suitable solution is a saline solution. After a contact lens wearer disinfected a contact lens in the first compartment, the contact lens is removed from the pouch and placed on the palm of the wearer's hand. By tearing along the tear-line at the top of the second compartment, the rinse solution can be poured onto the contact lens to complete the rinsing operation. The lens can then be installed into the eye.

This embodiment is more suitably used in an application where a solution for cleaning and disinfecting and a separate solution for rinsing and lubricating are used.

In a second alternate embodiment, a pouch that has three separate compartments may be constructed. Each of the first two compartments are equipped with a resealable top designed to store a left eye contact lens and a right eye contact lens, respectively. The third compartment which contains a rinsing solution is equipped with a non-resealable tear-line at the top for opening. The rinsing solution in the third compartment can be used to rinse both the left eye contact lens and the right eye contact lens after the two lenses are cleaned and disinfected in the first and the second compartment, respectively.

The present invention is further directed to a method of using a contact lens pouch equipped with a resealable top and prefilled with a contact lens care solution to clean, disinfect, store, and rinse contact lenses. The pouch is flexible and can be carried around by the contact lens wearer conveniently and can be used once and then be discarded.

BRIEF DESCRIPTION OF THE DRAWINGS

Other objects, features and advantages of the present invention will become apparent upon consideration of the specification and the appended drawings, in which:

FIG. I is a schematic view of the preferred embodiment wherein the contact lens pouch is equipped with a resealable top.

FIG. 2 is an enlarged cross-sectional view of FIG. 1 taken along line A—A.

FIG. 3 is a schematic view of a first alternate embodiment wherein two compartments are provided.

FIG. 4 is a schematic view of a second alternate embodiment wherein three compartments are provided.

DETAILED DESCRIPTION OF THE EMBODIMENTS

Referring initially to FIG. I wherein a schematic view of a contact lens pouch 10 which has a resealable top 12 is shown. The resealable top 12 is equipped with a resealable sealing means 20. In this preferred embodiment, the resealable sealing means 20 is a plastic inter-locking device. An enlarged cross sectional view of this plastic inter-locking device is shown in FIG. 2. This plastic inter-locking device is similar to that used in food storage bags commonly known as Zip-Lock bags.

The pouch 10 is prefilled with a lens care solution 14 before being marketed to the consumers. A suitable volume for such solution is approximately 4 to 10 ml.

The pouch 10 can be made with any suitable plastic material that is substantially flexible. The plastic material is first extruded into sheets and then thermoformed into bags. The plastic inter-locking device is frequently bonded to the sheets in a secondary operation. It can also be extruded into the sheets in the plastic extrusion process.

The plastic material should be capable of being sterilized at 120° C. without substantial loss of its physical properties of dimensional stability, warpage, and shrinkage. The plastic material should have low water and vapor permeability to prevent the evaporation and loss of the lens care solution. The plastic material should not be permeable to bacteria and oxygen in order to avoid contamination and to keep the efficacy of the solution.

A plastic material that is inert to most lens care solutions is polyethylene. A polyethylene sheet, in a very thin form, is not a good barrier to oxygen and to light transmission. Preferably, polyethylene is used by incorporating a filler to change its optical clarity such that light transmission can be reduced.

Polyethylene thin film may also can be laminated to a thin metal foil, such as an aluminum foil. The laminated film can be used as a pouch material with the polyethylene side facing the solution. The metal foil functions to block oxygen diffusion and light transmission.

The plastic inter-locking device can be extruded of a high density polyethylene material. In such case, it can be laminated to the polyethylene film in a separate manufacturing process.

In the preferred embodiment which illustrates a single compartment, an "all-in-one" type of lens care solution capable of accomplishing the functions of cleaning, disinfecting, storing, rinsing and lubricating all by a single solution is most suitably used. One of such solutions is available under the tradename of Complete® supplied by Allergan, Inc. However, it should be appreciated that other lens care solutions may also be suitably used in the pouch shown in FIG. 1 to accomplish only a single function of lens regimen, i.e., cleaning, disinfecting, rinsing, or lubricating.

It should be noted that the pouch shown in FIG. 1 containing a prefilled lens care solution may be reused instead of being discarded after one use. However, the contact lens wearer should avoid contaminating the solution and thus losing its sterility.

Instead of using a polyethylene/metal foil laminate, it is also possible to use a polyethylene film that has metal particles deposited on it by either a vapor deposition process or by a metal thermal spray process. Only a very thin film of metal is required to minimize the oxygen diffusion and the light transmission through the polyethylene film.

In FIG. 2, an enlarged cross-sectional view of the plastic inter-locking device 20 is shown. A male portion 16 of the inter-locking device is shown in a juxtaposed position to a female portion 18. When pressure is applied to 16 and 18 by pressing the films 22 and 24 together, a fluid-tight seal is accomplished by the engagement of the male portion 16 into the female portion 18.

In a method of using the pouch 10 in FIG. 1, a contact lens wearer opens the pouch by disengaging the plastic inter-locking device 20 at the top 12 and deposits a contact lens into the pouch. The pouch is then resealed by engaging the plastic inter-locking device 20 to achieve a fluid-tight seal. After the contact lens is deposited in pouch 10 for a period of time, i.e., a generally recommended minimum time period for disinfecting is four hours, the plastic inter-locking device 20 is opened and the contact lens is removed from pouch 10 and after rinsing, placed in the eye.

In a first alternate embodiment, as shown in FIG. 3, a contact lens pouch 30 is provided with two compartments 50 and 60. A fluid-tight seal 52 is formed in between the two compartments 50 and 60 during the thermoforming process. Compartment 50 is equipped with a plastic inter-locking device 40 at the top. Compartment 50 is also prefilled with a contact lens cleaning and disinfecting solution 36. Compartment 60 is equipped with a perforated tear-line 32 at the top. A rinsing solution 34 is prefilled in compartment 60. A suitable volume of such rinsing solution is approximately 2 to 4 ml. The rinsing solution 34 can be accessed by tearing along tear-line 32 to open the compartment and then pouring the solution onto a contact lens after the lens has been suitably disinfected. Tear-line 32 is perforated for easy tearing and cannot be resealed once it is torn.

The material used for compartment 50 and compartment 60 in pouch 30 is similar to that used in pouch 10 described in the preferred embodiment. A typical rinsing solution for filling compartment 60 is a saline solution.

In a method of using the contact lens pouch shown in FIG. 3, a contact lens is first deposited in compartment 50 which contains the cleaning, disinfecting, and storing solution for a sufficient length of time to clean and disinfect the lens. Compartment 50 is then reopened at the plastic interlocking device 40 and the contact lens is removed. Tear-line 32 at the top of compartment 60 is then torn open and the rinsing solution is poured onto the contact lens for the final rinsing before the lens is put into the eye.

In a second alternate embodiment, as shown in FIG. 4, a contact lens pouch 100 that has three separate compartments is provided. Compartments 70 and 80 are each used to clean, disinfect, and store a left eye contact lens and a right eye contact lens, respectively. These two compartments are each marked for left or right and are each equipped with a plastic inter-locking device at the top of the compartment. Compartment 90 which is equipped with a tear line at the top is used to hold a rinsing solution.

A method of using this second alternate embodiment comprises the steps of cleaning and disinfecting the left eye contact lens and the right eye contact lens in compartments 80 and 70, respectively for a sufficient length of time, and then removing the contact lenses from compartments 70 and 80 by opening the plastic inter-locking devices at the top of the compartments. The rinse compartment 90 is then opened and the rinsing solution contained therein is poured onto the two lenses for the final rinsing and wetting process before the lenses are inserted into the eyes.

While this invention has been described in an illustrative manner, it should be understood that the terminology used is intended to be in the nature of words of description rather than of limitation.

Furthermore, while the invention has been described in terms of one preferred and two alternate embodiments thereof, it is to be appreciated that those skilled in the art will readily apply these teachings to other possible variations of the invention.

The embodiments of the invention in which an exclusive property or privilege is claimed are defined as follows:

1. A flexible resealable pouch having at least one compartment prefilled with a contact lens care solution for the cleaning and storing of a contact lens comprising:

(a) a top portion which is open at the top thereof and which is equipped with a resealable plastic inter-locking device for achieving a fluid-tight seal;

(b) a bottom portion connected to and in fluid communication with said top portion for containment of said contact lens and said contact lens care solution, wherein said bottom portion comprises two compartments juxtaposed to each other, each in fluid communication with said top portion, with a permanent fluid-tight seal thereinbetween; and (c) a contact lens care solution disposed within said bottom portion.

2. A resealable pouch according to claim 1 wherein one of said compartments is equipped with said resealable plastic interlocking device for sealing said compartment and the other of said compartments is equipped with non-resealable sealing means for sealing said compartment.

3. A resealable pouch according to claim 2 wherein said non-resealable sealing means is a perforated tear-line.

4. A resealable pouch according to claim 1 wherein said pouch is made of a thermoplastic material.

5. A resealable pouch according to claim 1 wherein said pouch is made of a laminated film of a thermoplastic and a metal foil.

6. A resealable pouch according to claim 4 wherein said pouch is made of polyethylene.

7. A resealable pouch according to claim 6 wherein said polyethylene includes a filler which alters the optical clarity of said polyethylene such that transmission of light therethrough is reduced.

8. A resealable pouch according to claim 5 wherein said pouch is made of a laminated film of polyethylene and metal foil.

9. A resealable pouch according to claim 1 wherein said solution is a saline solution.

10. A resealable pouch according to claim 1 wherein said solution is a solution for cleaning, disinfecting, storing, rinsing and lubricating a contact lens.

11. A resealable pouch according to claim 1 wherein said solution is a solution for rinsing and lubricating a contact lens.

12. A resealable pouch according to claim 1 wherein said solution is a solution for cleaning and disinfecting a contact lens.

13. A resealable pouch according to claim 1 wherein said solution is present in an amount from about 4 to 10 ml.

14. A resealable pouch according to claim 1 wherein said pouch is substantially planar prior to being prefilled with said solution.

15. A resealable pouch according to claim 1 wherein one of said compartments is prefilled with a cleaning and disinfecting solution and the second of said compartments is prefilled with a rinsing solution.

16. A resealable pouch according to claim 1 wherein said bottom portion comprises three compartments juxtaposed to each other, each in fluid communication with said top portion, with permanent fluid-tight seals thereinbetween.

17. A resealable pouch according to claim 16 wherein two of said compartments are marked for left and right, respectively, and are each equipped with said resealable plastic interlocking device for sealing said compartments, and the third compartment is equipped with non-resealable sealing means for sealing said compartment.

18. A resealable pouch according to claim 17 wherein said non-resealable sealing means is a perforated tear-line.

19. A resealable pouch according to claim 17 wherein said left and right compartments are prefilled with a cleaning and disinfecting solution and said third compartment is prefilled with a rinsing solution.

* * * * *